US006223742B1

(12) United States Patent
Macameau

(10) Patent No.: US 6,223,742 B1
(45) **Date of Patent: *May 1, 2001**

(54) APPARATUS FOR HEATING PARTICULATE MATERIAL

(76) Inventor: Jullen Macameau, 164 Perreault, Val d'Or (CA), J9P 2H2

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/752,937

(22) Filed: Nov. 20, 1996

Related U.S. Application Data

(63) Continuation of application No. PCT/CA95/00145, filed on Mar. 20, 1995.

(51) Int. Cl.[7] ..... E01C 19/45; F24H 1/00
(52) U.S. Cl. ..... 126/343.5 R; 37/228
(58) Field of Search ..... 126/343.5 R, 343.5 A; 209/315; 37/227, 228, 229

(56) References Cited

U.S. PATENT DOCUMENTS

| | | | | |
|---|---|---|---|---|
| 1,742,968 | * | 1/1930 | Polak | 126/343.5 R |
| 2,178,400 | * | 10/1939 | Marino | 126/343.5 R |
| 2,364,315 | | 12/1944 | Powell . | |
| 2,590,701 | | 3/1952 | Hoffmann . | |
| 2,592,267 | | 4/1952 | Gangemi et al. . | |
| 2,599,098 | | 6/1952 | Flynn . | |
| 2,602,443 | | 7/1952 | Leary . | |
| 2,605,760 | | 8/1952 | Cayas . | |
| 3,126,883 | * | 3/1964 | Smith | 126/343.5 R |
| 3,171,405 | | 3/1965 | Miller . | |
| 3,259,123 | * | 7/1966 | Sangivanni | 126/343.5 R |
| 3,484,961 | * | 12/1969 | Coslowsky | 126/343.5 R |
| 3,577,975 | | 5/1971 | Farsbetter et al. . | |
| 3,766,586 | | 10/1973 | Krickovich . | |
| 3,803,732 | | 4/1974 | Moreno . | |
| 3,866,340 | | 2/1975 | Krickovich . | |
| 4,164,820 | | 8/1979 | Krickovich . | |
| 4,226,034 | | 10/1980 | Benjamin et al. . | |
| 4,353,176 | | 10/1982 | Hess . | |
| 4,409,957 | | 10/1983 | Muhammad . | |
| 4,615,129 | | 10/1986 | Jackson . | |
| 4,676,224 | | 6/1987 | Ohno . | |
| 4,785,561 | | 11/1988 | Swanson . | |
| 5,079,865 | | 1/1992 | Hutson . | |
| 5,199,574 | * | 4/1993 | Hollyfield, Jr. et al. | 209/315 |
| 5,235,762 | | 8/1993 | Brady . | |

FOREIGN PATENT DOCUMENTS

| | | |
|---|---|---|
| 931844 | 8/1973 | (CA) . |
| 673612 | 6/1952 | (GB) . |
| 1-178607 | 7/1989 | (JP) . |
| 70358 | 5/1927 | (SE) . |
| 225 529 | 5/1968 | (SE) . |

* cited by examiner

*Primary Examiner*—James C. Yeung
(74) *Attorney, Agent, or Firm*—Swabey Ogilvy Renault; Michel Sofia

(57) ABSTRACT

Suitable for melting snow, the apparatus has a flame heater for melting snow directly by flame contact directed from above, a conveyor for transporting snow to the flame heater for melting, and a drainage for allowing water to drain while the snow is being melted. A container is included for receiving snow removed from a road surface. A vibrated netting inside the container receives snow through an opening in the container. The snow passes through the netting while catching larger solid masses of ice contained within the snow. A reservoir holds the drainage water which can be pumped into a storm drain through a wind-up hose.

6 Claims, 4 Drawing Sheets

APPARATUS FOR HEATING PARTICULATE MATERIAL

This application is a continuation of international PCT patent application Ser. No. PCT/CA95/00145 filed Mar. 20, 1995 with a designation of the United States.

FIELD OF THE INVENTION

The present invention relates to an apparatus for heating particulate material, and more particularly to industrial equipment for clearing snow by melting consisting of a conveyor system which transports snow dumped in a container to a combustion chamber which operates using a series of burners producing a hot and naked flame.

BACKGROUND ART

All existing equipment, either mobile, semi-mobile or stationary, is based on a common principle: that snow and ice are melted in a single receptacle being at the same time a snow container and a combustion chamber. By diffused internal heat, that is by hot air blown or by hot water radiators or any other combination, the snow is melted inside the mechanical means used to produce the heat. Furthermore, this indirect heat is used only once, generating significant operating costs.

Existing equipment consists of devices pulled by tractor or tractor-trailer moving continually during snow removal and melting operations, without any system for recovering the water produced. Consequently, the water produced during the operation must be evacuated simultaneously by the machine, which does not have the capacity to channel it toward a specific location, such as municipal sewers.

Furthermore, existing devices do not have a mechanism for the recovery of sand and other debris contained in the snow, nor a filtration system to reduce the formation of salt spray. Similarly, they cannot be used for anything but melting snow or ice.

SUMMARY OF THE INVENTION

It has been discovered that these disadvantages can be overcome by providing an apparatus for melting snow comprising a flame heater for melting the snow directly by flame contact directed from above, a conveyor for transporting the snow to the flame heater for melting, and means for allowing water to drain while the snow is being melted.

It has been further discovered that these disadvantages can also be overcome by providing an apparatus for heating particulate material comprising a container for receiving the material and having an opening, a netting provided in the container receiving the material through the opening and through which the particulate material passes while catching larger solid masses contained within the paticulate material and improving a consistency of the particulate material, means for vibrating the netting to cause the particulate material to pass therethrough, a heater for heating the material, and a conveyor transporting the material passing through the netting to the heater.

According a one preferred aspect of the invention, these disadvantages can be overcome by providing using a snow removal device that can be operated in a fixed position or pulled by a tractor, tractor-trailer, snowplow, snowblower or other vehicle. This device consists of a container into which snow is dumped directly through an opening in the back of the device, as well as an independent combustion chamber in which snow is melted by using burners. These burners produce a hot and naked flame. A variable speed conveyor system introduces the snow from the container into the combustion chamber gradually and particularly under the hot and naked flame of the burners, thereby producing almost instantaneous melting.

In addition, the invention includes a mechanism for the recovery of the sand and other debris contained in snow and a water vapor filtration system to reduce the amount of salt spray released into the atmosphere, and finally a heat recycling system in which the heat produced by the burners is used three times before being released from the device.

The device is also equiped with a back opening which allows snow to be deposited directly by a snowblower or other snow removal equipment, and a system for evacuating water directly into any water sewer simultaneously during the snow removal and melting process.

The invention also has applications in fields other than snow removal. As a first example, it can be used to dry or heat sand for use as an abrasive on roads. As a second example, it can be used to dry or heat soil for agricultural use. Furthermore, it can be used to heat asphalt for road repairs.

BRIEF DESCRIPTION OF THE DRAWINGS

The invention will be better understood by way of the following detailed description of a preferred embodiment of the invention with reference to the appended drawings, in which.

DETAILED DESCRIPTION OF THE PREFERRED EMBODIMENT

Figure 1:
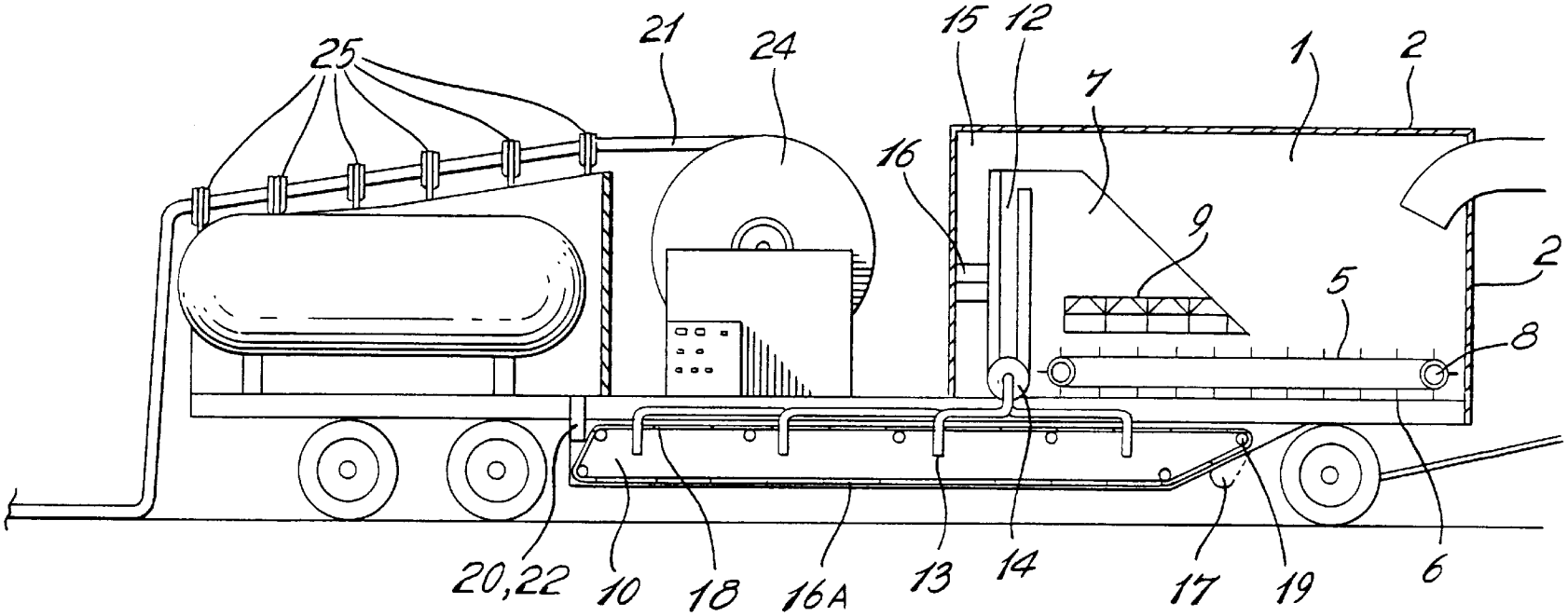
FIG. 1 shows a side view of the preferred embodiment mounted on a trailer pulled by a snowblower.
Figure 2:
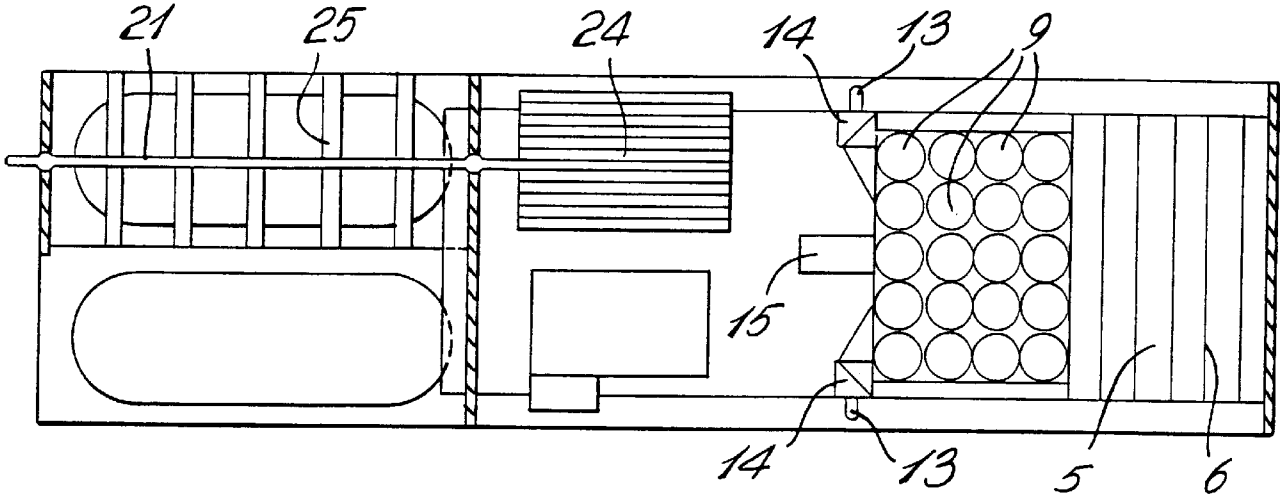
FIG. 2 shows a top plan view of the preferred embodiment.

As shown in FIG. 1, the snow clearing apparatus clears snow by melting and can be operated in a fixed position or pulled by either an independent motor force such as a tractor-trailer or snowblower, or by any other means. The apparatus includes a container 1 (FIG. 1) disposed at one end of the device into which snow and ice are dumped through the container's opening 2 (FIG. 2). The opening 2 is located in the upper part or less than half of the vertical side at one end of the container 1 and half or less of the container's ceiling part adjacent to the end of the container 1.

Figure 4:
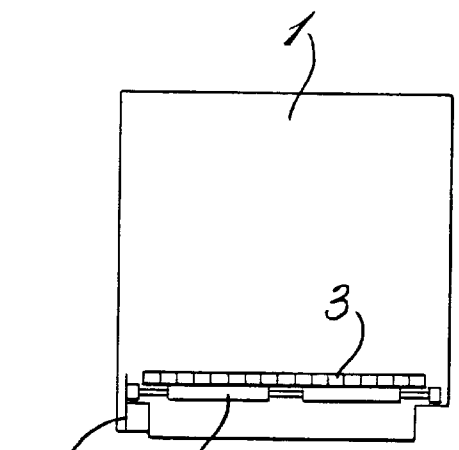
FIG. 4 shows a cross-section of the container and its accessories.
Figure 3:
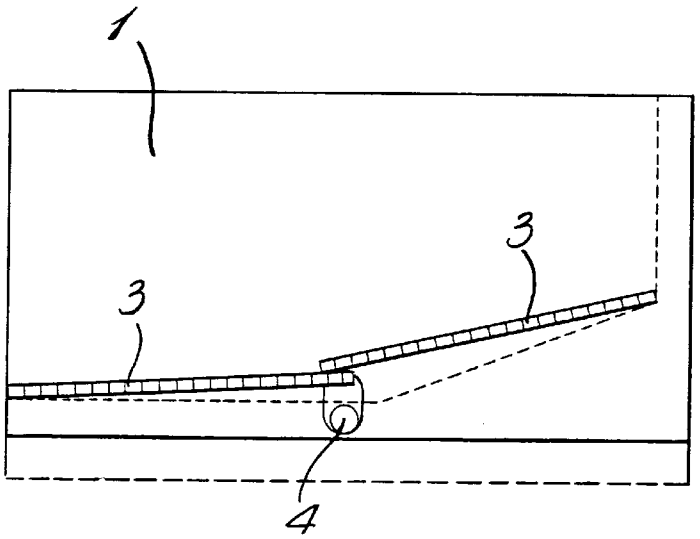
FIG. 3 shows a side view of the container and its accessories.

A two-part wire netting 3 (FIGS. 3 and 4) covers the entire length and width of the container 1, and is laid down at any angle. The first part of the wire netting 3 is disposed at the opposite end of the container's opening 2 and is restrained by some means to the vertical side of the container on one end and rests on a camshaft 4 at the other end. The other part of the wire netting 3, located in the adjacent part of the opening 2, rests on the lower edge of the opening 2 on one end so that large pieces of ice fall onto the road, and the other end of the other part of the wire netting rests on the camshaft 4. The camshaft 4, which is situated in the middle part of the container 1, is driven by any suitable type of motor and it is used to sift snow and ice particles which will fall into the bottom of container 1 where they are picked up by a conveyor 5 (FIGS. 1 and 2).

Figure 5:
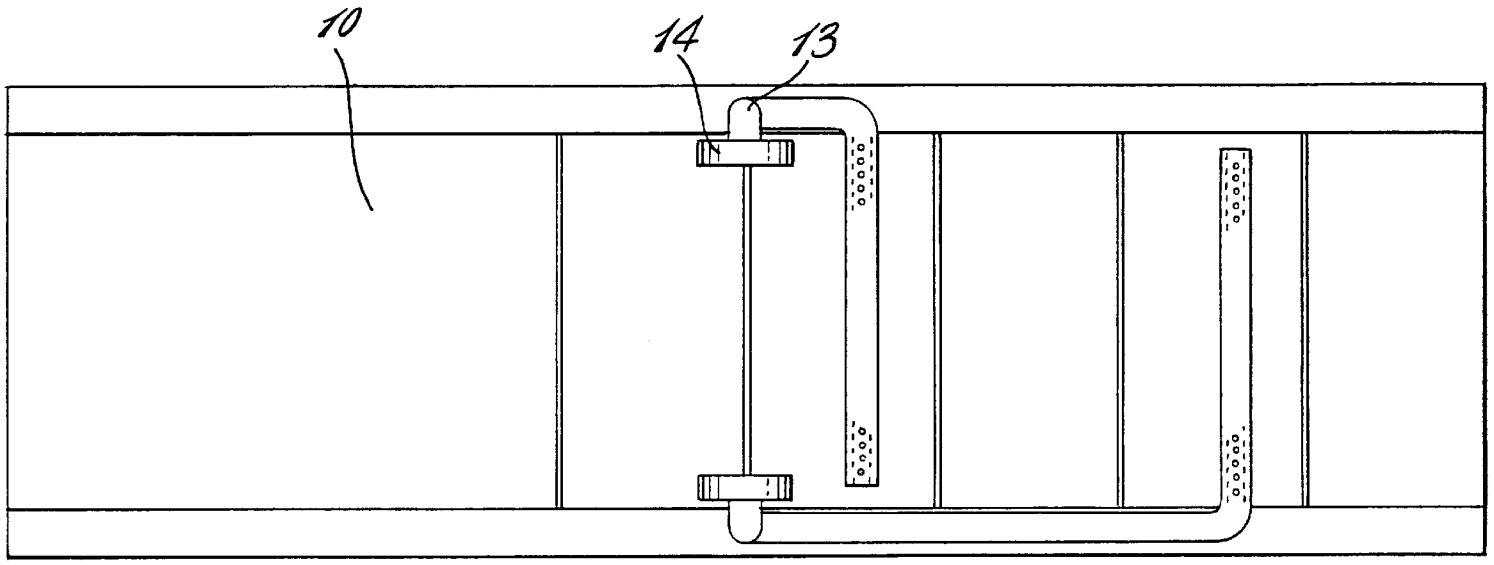
FIG. 5 shows a top plan view of the water evacuation system in the recovery basin.
Figure 6:
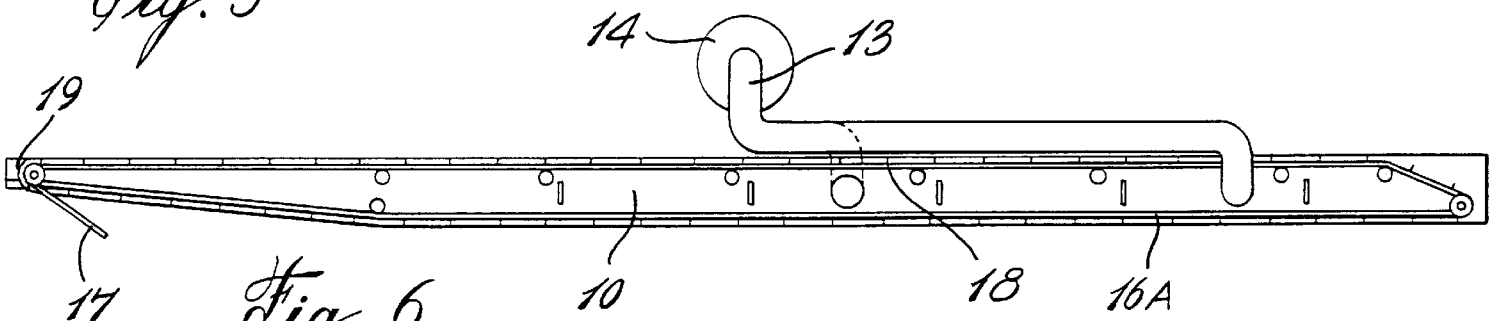
FIG. 6 shows a side view of the recovery basin where the conduit releases its heat.
Figure 7:
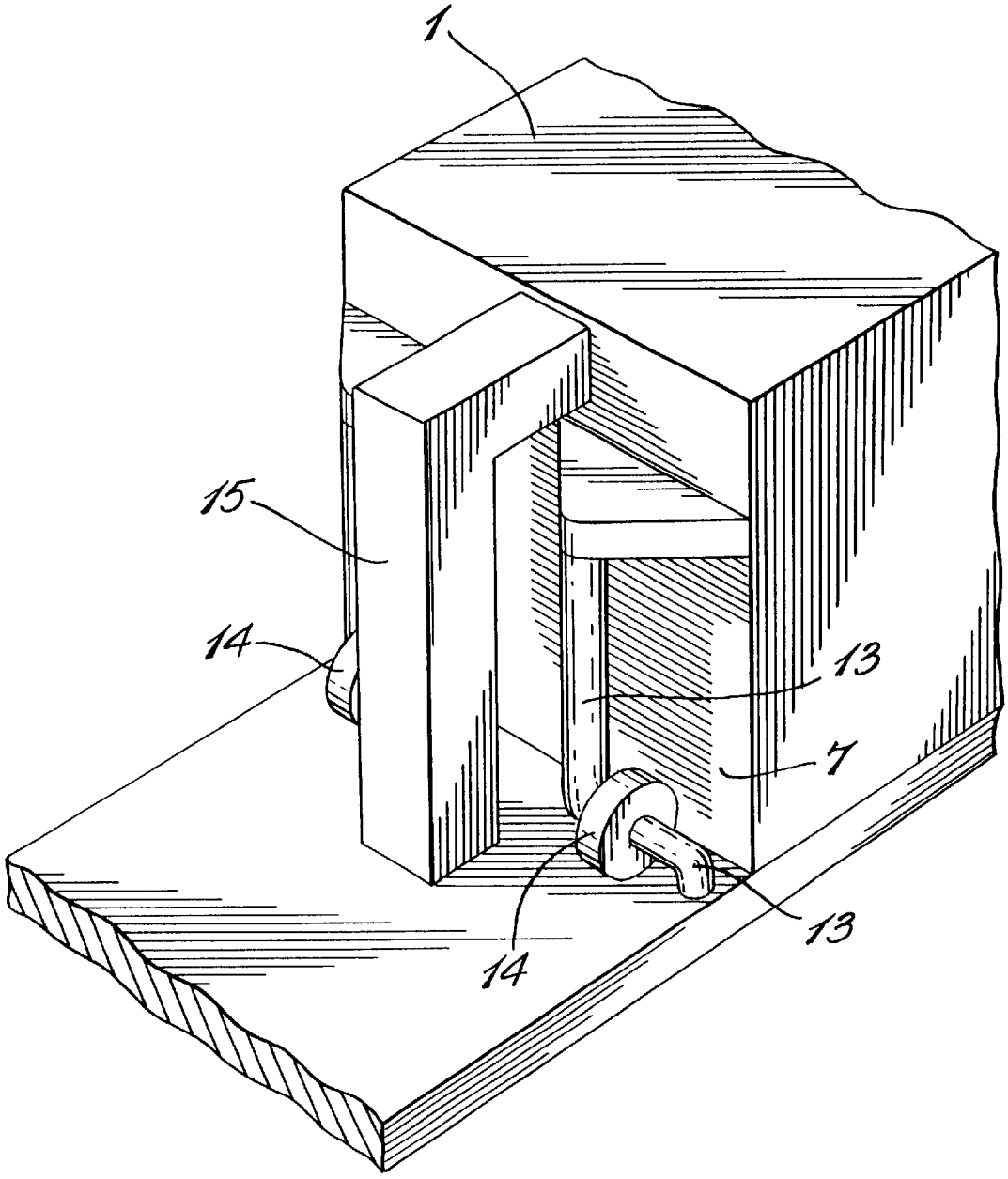
FIG. 7 shows a side view of the heat saving system.

The conveyor 5 is equiped with scrapers 6 (FIGS. 1 and 2) which are transversally disposed. Furthermore the conveyor 5 is the same width as the combustion chamber 7. The conveyor 5 introduces the snow and ice into the combustion chamber 7 gradually (FIG. 1) and it has variable speeds. The conveyor is driven by a gear system 8 (FIG. 1). The gear system is installed at one end of the conveyor 5 and is powered by a suitable type of motor. The combustion chamber 7, being adjacent to the container 1, contains the burners 9 (FIGS. 1 and 2) which produce a hot and naked flame under which snow and ice transported by the conveyor 5 melt. The entire floor of the combustion chamber 7 has holes for an equivalent of fifty per cent (50%) of its surface, which encourage the evacuation of water produced by melting snow into a recovery basin 10 (FIGS. 1, 5 and 6). On the floor of of the combustion chamber 7 passes the conveyor 5.

The burners 9 are disposed on a suitable support which is attached to all of the vertical sides of the combustion chamber 7 above the floor so as to provide a flame on the entire surface of the combustion chamber 7. The burners 9 are fueled by a hydrocarbon fuel and their position and/or setting is adjustable. The intensity of the heat generated by the burners 9 is controlled according to the type of snow and/or ice to be treated and the speed of the conveyor 5. A cloth composed of heat reflective strips or other material is disposed vertically in the center of container 1 in order to retain the heat contained in the opposite part of the container's opening 2. One or more chimneys 12 (FIG. 1) are located in the combustion chamber 7 at the opposite end of the container 1. The chimneys 12 are used to evacuate the heat contained in the combustion chamber 7 towards one or more conduits 13 (FIGS. 1, 2, 5, 6 and 7). Each conduit 13 is equiped with one or more fans 14 (FIGS. 1, 2, 5, 6 and 7) which aspire the heat and blow it into the recovery basin 10 where it is used a second time. The same heat is reused a third time after its recovery by a third chimney 15. This heat goes upward to the container 1 where the heat remains in the container 1 because of the reflective cloth 11, thereby allowing the snow and ice stored within the container to melt as soon as they arrive in the device. The chimney 15 is equiped with filters 16 (FIG. 1) composed of carbon or other material to filter salt spray.

The recovery basin 10 is located under the container 1 and the combustion chamber 7. The basin 10 contains a second conveyor 16A (FIGS. 1 and 6) which transports sand contained in the snow and ice which fall through the holed floor of the combustion chamber 7 towards an opening 17 (FIGS. 1 and 6) disposed at one end of the conveyor 16A. The conveyor 16A has the same width as the basin 10 and is equiped with scrapers 18 (FIGS. 1 and 6) transversally disposed. The conveyor 16A is driven by a gear system 19 (FIGS. 1 and 6) installed at one end of the conveyor 16A. The water produced by the melting snow and ice passes through the holed floor of the combustion chamber 7 up to recovery basin 10; the water is evacuated by a pump 20 (FIG. 1) and a hose 21 (FIG. 1) connected to an exit 22 (FIG. 1) which is disposed on one side of the basin. The hose 21 is rolled around a reel 24 (FIG. 1) which is driven by a suitable motor and is disposed in the same place where all of the accessories necessary for the operation of the device are disposed. A roller conveyor 25 (FIG. 1) holds the hose 21 in place during the water evacuation process.

BEST MODE OF THE INVENTION

An industrial equipment for clearing snow by melting that can be operated in a fixed position or pulled by either an independent motor force such as a tractortrailer or snowblower, or by any other means, including a container 1 (FIG. 1) disposed at one end of the device into which snow and ice are dumped through the container's opening 2 (FIG. 2). The opening 2 is located in the major part or less than half of the vertical side at one end of the container 1 and half or less of the container's ceiling adjacent part to the end of container 1. A two-part wire netting 3 (FIGS. 3 and 4) covering the entire length and width of the container 1 is laid down at an angle. The first part of wire netting 3 is disposed at the opposite end of the container's opening 2 and it is restrained at one end by a suitable hook on the vertical side of the container and rests on a cam-shaft 4 at the other end. The other part of wire netting 3, located in the adjacent part of the opening 2, rests on the lower edge of the opening 2 on one end so that large pieces of ice fall onto the road and the other end of the other part of the wire netting rests on the cam-shaft 4. The cam-shaft 4, which is situated in the middle part of the container 1 and is driven by a hydraulic motor, it is used to vibrate the netting to sift snow and ice particles. These particles will fall into the bottom of the container 1 where they are picked up by a conveyor 5 (FIGS. 1 and 2).

The conveyor 5 is the same width as the combustion chamber 7 and equiped with scrapers 6 (FIGS. 1 and 2) transversally disposed. The conveyor 5 introduces snow and ice into the combustion chamber 7 gradually (FIG. 1) at a speed of between zero and two feet per second (0–60 cm/s). The conveyor is driven by a gear system 8 (FIG. 1) installed at one end of the conveyor 5 and powered by a hydraulic motor. The combustion chamber 7 is adjacent to the container 1, and contains the burners 9 (FIGS. 1 and 2) which produce a hot and naked flame under which snow and ice transported by the conveyor 5 melt. While the sifting eliminates larger ice particles, it also ensures a somewhat even consistency in the snow falling onto conveyor 5 which yields a more even and efficient melting of the snow.

The entire floor of the combustion chamber 7 has holes for an equivalent of fifty per cent (50%) of its surface, which encourage the drainage of water produced by melting snow into a recovery basin 10 (FIGS. 1, 5 and 6). On the floor of the combustion chamber 7 passes the conveyor 5. The burners 9 are fastened to an angle iron support attached to all vertical sides of the combustion chamber 7 with rods traversing the sides, so as to provide a flame on the entire surface of the combustion chamber 7. The burners 9 are consume fossil fuel and their position is adjustable. The intensity of the heat generated by the burners 9 is controlled according to the type of snow and/or ice to be treated and the speed of the conveyor 5. A cloth 11 composed of heat reflective strips or a curtain of metal strips is disposed vertically in the center of the container 1 in order to retain the heat contained in the opposite part of the container's opening 2.

One or more chimneys 12 (FIG. 1) are located in the combustion chamber 7 at the opposite end of the container 1. The chimneys 12 are used to evacuate the heat contained in the combustion chamber 7 towards one or more downward conduits 13 (FIGS. 1, 2, 5, 6 and 7). Each conduit 13 is equiped with one or more fans 14 (FIGS. 1, 2, 5, 6 and 7) which suck the heat and blow it into the recovery basin 10 where it is used a second time. The same heat is reused a third time after its recovery by a third chimney 15 where the heat goes upward to the container 1. The heat remains in the container 1 because of the reflective cloth 11, thereby allowing the snow and ice stored within the container 1 to melt as soon as they arrive in the device. The chimney 15 is equiped with carbon filters 16 (FIG. 1) to filter salt spray.

The recovery basin 10 is located under the container 1 and the combustion chamber 7. The basin 10 contains a second conveyor 16A (FIGS. 1 and 6) which transports sand or gravel contained in the snow and ice which fall through the holed floor of the combustion chamber 7 towards an opening 17 (FIGS. 1 and 6) disposed at one end of the conveyor 16A. The conveyor 16A has the same width as the basin 10 and is equiped with scrapers 18 (FIGS. 1 and 6) transversally disposed, and is driven by a gear system 19 (FIGS. 1 and 6) installed at one end of the conveyor 16A. The water produced by the melting snow and ice passes through the holed floor of the combustion chamber 7 up to said recovery basin 10. The water is evacuated by a pump 20 (FIG. 1) and a hose 21 (FIG. 1) connected to an exit 22 (FIG. 1) disposed on one side of the basin 10. The length of hose 21 is equivalent to the distance between two sewer traps and it is rolled up around a reel 24 (FIG. 1). The reel 24 is activated by a hydraulic motor and disposed at the same place where all accessories necessary for the operation of the device are disposed. A roller conveyor 25 (FIG. 1) holds the hose 21 in place during the water evacuation process.

The aforementioned device has other industrial applications in various fields. Firstly, it can be used to dry or heat sand for use as an abrasive on roads. Secondly, it can be used to dry or heat soil for agricultural use. Finally, it can be used to heat asphalt for road repairs.

I claim:

1. An apparatus for melting particulate material comprising:

a container for receiving said material and having an opening;

a netting provided in said container receiving said material through said opening and through which said particulate material passes while catching larger solid masses contained within said material and improving a consistency of said particulate material;

means for vibrating said netting to cause said material to pass therethrough;

a flame heater for heating said material; and a conveyor transporting said material passing though said netting to said heater.

2. The apparatus as defined in claim 1, wherein said material is snow removed from road surfaces, said flame heater melts said snow, and said netting catches pieces of ice mixed in with said removed snow.

3. The apparatus as defined in claim 2, wherein said flame heater directly melts said snow carried by said conveyor by flame contact directed from above.

4. The apparatus as defined in claim 2, further comprising a reservoir for receiving water from said melted snow.

5. The apparatus as defined in claim 1, wherein said netting has two wire netting sections and said vibrating means is connected to an adjacent end of each one of said two parts.

6. The apparatus as defined in claim 2, wherein said netting has two wire netting sections and said vibrating means is connected to an adjacent end of each one of said two parts.

* * * * *